US010704782B2

(12) United States Patent
Lynch

(10) Patent No.: US 10,704,782 B2
(45) Date of Patent: Jul. 7, 2020

(54) CONTAINER ILLUMINATION DEVICE

(71) Applicant: Linda Lynch, Bethpage, NY (US)

(72) Inventor: Linda Lynch, Bethpage, NY (US)

( * ) Notice: Subject to any disclaimer, the term of this patent is extended or adjusted under 35 U.S.C. 154(b) by 0 days.

(21) Appl. No.: 16/149,664

(22) Filed: Oct. 2, 2018

(65) Prior Publication Data

US 2019/0101278 A1 Apr. 4, 2019

Related U.S. Application Data

(60) Provisional application No. 62/566,775, filed on Oct. 2, 2017.

(51) Int. Cl.

| | |
|---|---|
| ***F21V 33/00*** | (2006.01) |
| ***B65D 23/08*** | (2006.01) |
| ***B65D 23/12*** | (2006.01) |
| ***F21V 17/02*** | (2006.01) |
| ***F21V 17/10*** | (2006.01) |
| ***F21V 23/02*** | (2006.01) |
| ***F21V 21/08*** | (2006.01) |
| ***F21W 131/30*** | (2006.01) |
| ***B65D 23/00*** | (2006.01) |

(52) U.S. Cl.

CPC ..... *F21V 33/0028* (2013.01); *B65D 23/0885* (2013.01); *B65D 23/12* (2013.01); *F21V 17/02* (2013.01); *F21V 17/10* (2013.01); *F21V 17/108* (2013.01); *F21V 21/0832* (2013.01); *F21V 23/02* (2013.01); *B65D 23/001* (2013.01); *F21W 2131/30* (2013.01)

(58) Field of Classification Search

CPC ..... F21V 33/0028; F21V 17/02; F21V 17/10; F21V 17/108; F21V 23/02; F21V 21/0832; B65D 23/0885; B65D 23/12; B65D 23/001; F21W 2131/30

See application file for complete search history.

(56) References Cited

U.S. PATENT DOCUMENTS

| | | | | |
|---|---|---|---|---|
| 6,086,216 | A | 7/2000 | Goldfarb | |
| 6,793,363 | B2 * | 9/2004 | Jensen | A47G 23/0309 362/101 |
| 8,960,125 | B1 * | 2/2015 | Brown | A01K 7/00 119/72 |
| 9,022,252 | B2 * | 5/2015 | Beggins | B65D 81/3879 215/393 |
| 9,241,585 | B2 * | 1/2016 | Marks | A47G 7/085 |
| 9,255,707 | B2 | 2/2016 | Chuang | |
| 9,539,942 | B2 | 1/2017 | Salter et al. | |
| 2007/0028519 | A1 * | 2/2007 | Seibel | A47G 7/085 47/72 |

(Continued)

*Primary Examiner* — Joseph L Williams
*Assistant Examiner* — Jose M Diaz
(74) *Attorney, Agent, or Firm* — Carter, DeLuca & Farrell LLP

(57) ABSTRACT

An illumination device includes a sleeve, a securing member, and a light source. The sleeve defines a cavity and includes an open upper end communicating with the cavity and a lower end. The open upper end and the cavity are dimensioned to receive a fluid container. The securing member is supported on the sleeve and is adapted to secure the sleeve tightly about fluid containers having different diameters. The light source includes a light bulb and a power source and is supported on the sleeve in a position to direct light into the cavity.

14 Claims, 2 Drawing Sheets

(56) References Cited

U.S. PATENT DOCUMENTS

| | | | | |
|---|---|---|---|---|
| 2012/0106130 | A1* | 5/2012 | Beaudette | A47G 23/0309 362/92 |
| 2013/0240549 | A1* | 9/2013 | Beggins | B65D 21/086 220/739 |
| 2015/0300626 | A1 | 10/2015 | Chuang | |
| 2017/0009979 | A1* | 1/2017 | Willows | F21V 33/0004 |

* cited by examiner

CONTAINER ILLUMINATION DEVICE

BACKGROUND

Technical Description

The present disclosure is directed to illumination devices and, more particularly, to illumination devices that are adapted to illuminate a beverage container.

SUMMARY

One aspect of the present disclosure is directed to an illumination device including a sleeve, a securing member, and a light source. The sleeve defines a cavity and has an open upper end that communicates with the cavity and a lower end. The open upper end is dimensioned to receive a fluid container. The securing member is supported on the sleeve and is adapted to secure the sleeve tightly about fluid containers having different diameters. The light source includes a light bulb and a power source and is supported on the sleeve in a position to direct light into the cavity.

In embodiments, the securing member includes an elastic member positioned at least partly about the cavity of the sleeve.

In some embodiments, the securing member includes at least one adjustable strap positioned adjacent the open upper end of the sleeve.

In certain embodiments, each of the at least one straps includes hook and loop fasteners.

In embodiments, the securing member includes a tie string positioned at least partly about the cavity of the sleeve.

In some embodiments, a locking device supported on the tie string.

In certain embodiments, the securing member includes a zipper.

In embodiments, the sleeve is formed of a pliable material.

In some embodiments, the sleeve is formed of a resilient material.

In certain embodiments, the sleeve is formed of a flexible material.

In embodiments, the sleeve includes a pocket configured to receive the light source.

BRIEF DESCRIPTION OF THE DRAWINGS

Various embodiments of the presently disclosed container illumination device are described herein below with reference to the drawings, wherein.

DETAILED DESCRIPTION OF EMBODIMENTS

Figure 1:
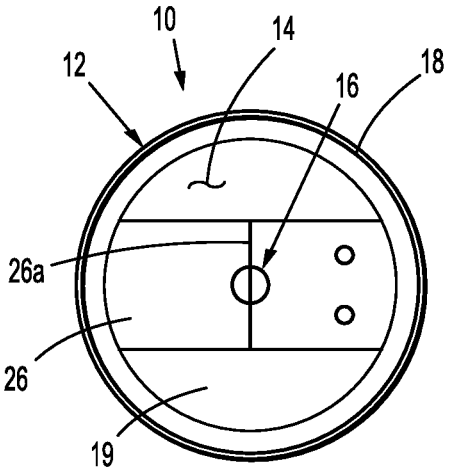
FIG. 1 is a top view of one exemplary embodiment of the presently disclosed container illumination device.

The presently disclosed container illumination device will now be described in detail with reference to the drawings in which like reference numerals designate identical or corresponding elements in each of the several views. However, it is to be understood that the disclosed embodiments are merely exemplary of the disclosure and may be embodied in various forms. Well-known functions or constructions are not described in detail to avoid obscuring the present disclosure in unnecessary detail. Therefore, specific structural and functional details disclosed herein are not to be interpreted as limiting, but merely as a basis for the claims and as a representative basis for teaching one skilled in the art to variously employ the present disclosure in virtually any appropriately detailed structure.

Figure 1A:
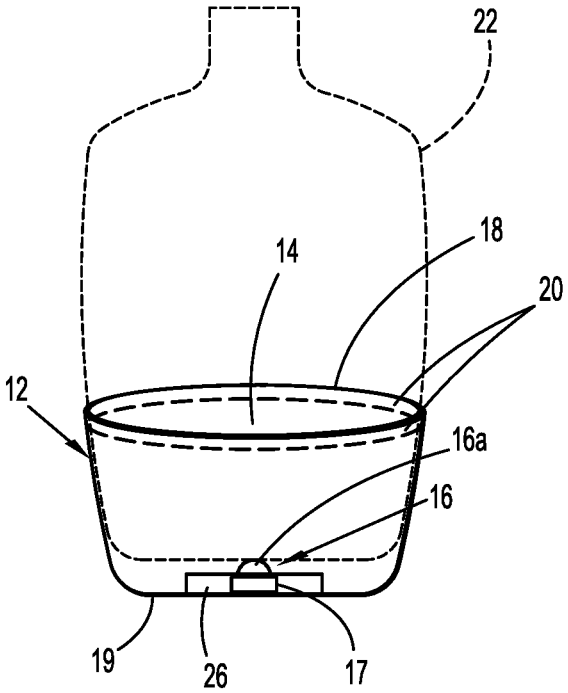
FIG. 1A is a side perspective view of the container illumination device shown in FIG. 1.

FIGS. 1 and 1A illustrate one exemplary embodiment of the presently disclosed container illumination device shown generally as 10. The container illumination device 10 includes a sleeve 12 defining a cavity 14, and a light source 16. In embodiments, the sleeve 12 is formed from a flexible, resilient, and/or pliable material and defines an upper open end 18 and lower end wall 19. In embodiments, the upper open 18 end supports an elastic member 20 that is positioned partly or entirely about the open end 18. The elastic member 20 is positioned to secure the open end 18 of the container illumination device 10 about a container 22 (shown in phantom in FIG. 1A) as discussed in further detail below.

The light source 16 includes a light bulb 16*a* and a power source 17 (shown schematically) such as a battery. The light bulb 16 can include any known light emitting device. In embodiments, the light source 16 is supported within a pouch 26 defined on the closed end 19 of the sleeve 12. The pouch 26 can define a slit 26*a* (FIG. 1) that is dimensioned to facilitate passage of the light source 16 into the pouch 26. Alternately, other devices can be used to secure the light source 16 within the cavity of the 14 of the sleeve 12 such as hook and loop fasteners, snaps or the like. Although the pouch 26 is shown to be disposed on the end wall 19 of the sleeve 12, it is envisioned that the light source 16 can be secured along a side wall of the sleeve 12.

In embodiments, the end wall 19 need not be closed but rather may be in the form of a strip of material that extends across the sleeve 12.

In embodiments, the sleeve 12 can be formed from a variety of materials including polymers and fabrics. As discussed above, the material can be pliable and/or flexible or resilient to facilitate attachment to containers 22 having a variety of different sizes. In use, a base of the container 22 is positioned within the cavity 14 defined by the sleeve 12 and the light source 16 is actuated to direct light through walls of the container 22. The elastic member 20 helps to secure the illumination device 10 to the container 22. As the light travels through the liquid within the container 22, the light makes the container glow.

The presently disclosed illumination device 10 can be used by walkers and joggers as a safety device to alert car drivers to their presence. More specifically, the presently disclosed illumination device 10 can be used with beverage containers, including water bottles and the like, to illuminate the beverage container and improve the visibility of the walker or jogger. In addition, the illumination device 10 can be attached to fluid containers of children to allow parents to more easily identify their especially at night.

Figure 2:
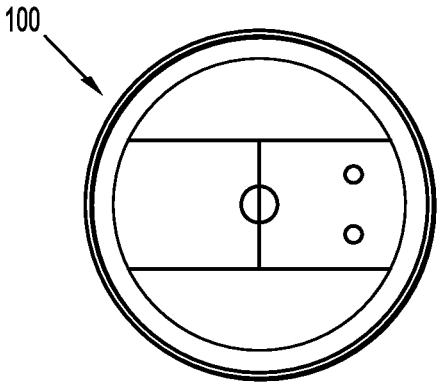
FIG. 2 is a top view of another exemplary embodiment of the presently disclosed container illumination device.
Figure 2A:
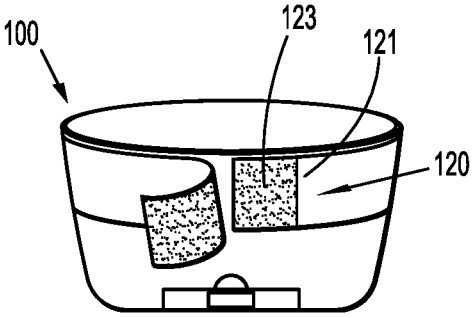
FIG. 2A is a side perspective view of the container illumination device shown in FIG. 2.
Figure 3:
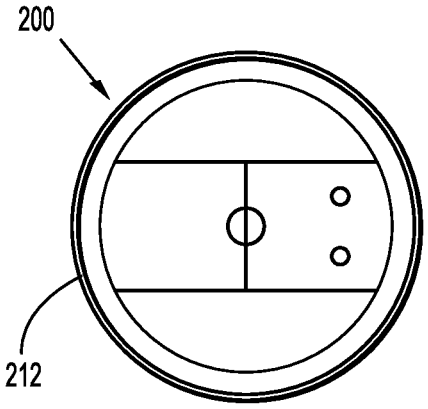
FIG. 3 is a top view of another exemplary embodiment of the presently disclosed container illumination device.
Figure 3A:
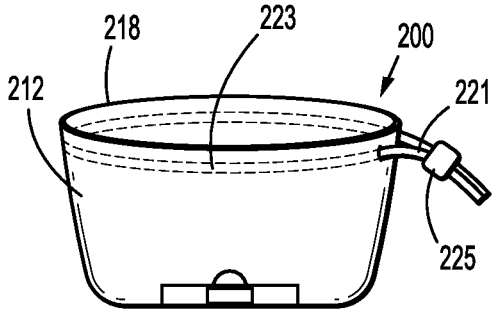
FIG. 3A is a side perspective view of the container illumination device shown in FIG. 3.
Figure 4:
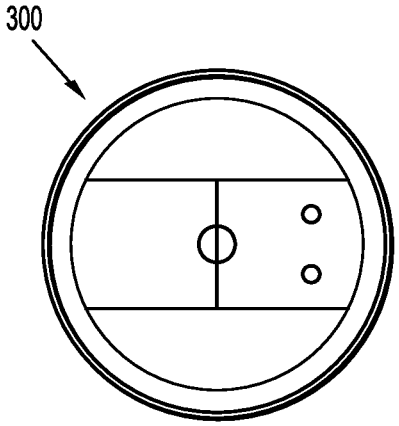
FIG. 4 is a top view of yet another exemplary embodiment of the presently disclosed container illumination device.
Figure 4A:
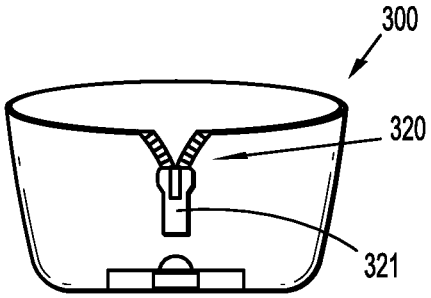
FIG. 4A is a side perspective view of the container illumination device shown in FIG. 4.

FIGS. 2-4A illustrate alternate embodiments of the presently disclosed illumination device which are substantially similar to the illumination device 10 (FIG. 1) except that the elastic member 20 is replaced with a different securing device. In FIGS. 2-2A, the illumination device 100 includes a securing device 120 having straps 121 that include hook and loop fasteners 123. In FIGS. 3-3A, the illumination device 200 includes a securing device 220 having a tie string 221 that is positioned with a cuff 223 defined about the open end 218 of the sleeve 212. The tie string 221 may support a locking device 225 to tightly secure the open end of the sleeve 212 about a container. In FIGS. 4-4A, the illumination device 300 includes a securing device 320 including a zipper 32.

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. An illumination device comprising:

a sleeve defining a cavity, the sleeve having an open upper end communicating with the cavity and a lower end, the open upper end dimensioned to receive a fluid container, the lower end of the sleeve including a pouch defining a slit;

a securing member supported on the sleeve, the securing member being adapted to secure the sleeve tightly about fluid containers having different diameters; and a light source including a light bulb and a power source, the light source being supported on the sleeve in a position to direct light into the cavity, wherein the light source is supported within the pouch and the slit is dimensioned to facilitate passage of light through the slit.

2. The illuminating device of claim 1, wherein the securing member includes an elastic member positioned at least partly about the cavity of the sleeve.

3. The illuminating device of claim 1, wherein the securing member includes at least one adjustable strap positioned adjacent the open upper end of the sleeve.

4. The illuminating device of claim 3, wherein each of the at least one straps includes hook and loop fasteners.

5. The illuminating device of claim 1, wherein the securing member includes a tie string positioned at least partly about the cavity of the sleeve.

6. The illuminating device of claim 5, wherein further including a locking device supported on the tie string.

7. The illuminating device of claim 1, wherein the securing member includes a zipper.

8. The illuminating device of claim 1, wherein the sleeve is formed of a pliable material.

9. The illuminating device of claim 1, wherein the sleeve is formed of a resilient material.

10. The illuminating device of claim 1, wherein the sleeve is formed of a flexible material.

11. An illumination device comprising:

a sleeve defining a cavity, the sleeve having an open upper end communicating with the cavity and a lower end, the open upper end dimensioned to receive a fluid container, the lower end of the sleeve including a pouch defining a slit;

a securing member supported on the sleeve, the securing member being adapted to secure the sleeve tightly about fluid containers having different diameters; and a light source including a light bulb and a power source, the light source being supported on the sleeve in a position to direct light into the cavity, wherein the light source is supported within the pouch and the slit is dimensioned to facilitate passage of light through the slit;

wherein the securing member includes an elastic member, an adjustable strap, a tie string, or a zipper.

12. The illuminating device of claim 11, wherein the sleeve is formed of a pliable material.

13. The illuminating device of claim 11, wherein the sleeve is formed of a resilient material.

14. The illuminating device of claim 11, wherein the sleeve is formed of a flexible material.

* * * * *